US006448905B1

(12) United States Patent
Jones

(10) Patent No.: US 6,448,905 B1
(45) Date of Patent: Sep. 10, 2002

(54) ROBOTIC TRAFFIC SIGNALLING DEVICE

(76) Inventor: Darrell G. Jones, P.O. Box #429, Hubbard, OR (US) 97032

( * ) Notice: Subject to any disclaimer, the term of this patent is extended or adjusted under 35 U.S.C. 154(b) by 3 days.

(21) Appl. No.: 09/648,231

(22) Filed: Aug. 25, 2000

(51) Int. Cl.[7] ..... G08G 1/095

(52) U.S. Cl. ..... 340/907; 340/539; 340/908; 340/908.1; 340/925; 116/63 P; 116/63 R

(58) Field of Search ..... 340/907, 908, 340/908.1, 471, 326, 933, 917, 925, 539; 40/612, 606, 610; 116/63 P, 60 R

(56) References Cited

U.S. PATENT DOCUMENTS

| | | | | |
|---|---|---|---|---|
| 2,199,756 A | | 5/1940 | Ricard | |
| D190,283 S | | 5/1961 | Turner | |
| 3,886,519 A | | 5/1975 | Hovland | |
| 4,641,251 A | | 2/1987 | Inoue | |
| 5,001,475 A | * | 3/1991 | Scovin | 340/908 |
| 5,117,765 A | | 6/1992 | Wahl | |
| 5,450,811 A | | 9/1995 | Heiland | |
| 5,682,150 A | * | 10/1997 | Votava | 340/908 |
| 5,755,051 A | * | 5/1998 | Zumbuhl | 40/586 |
| 6,052,067 A | * | 4/2000 | Nuxoll | 340/908 |
| 6,104,313 A | * | 8/2000 | Boyd, II | 340/908.1 |
| 6,169,477 B1 | * | 1/2001 | Fiato | 340/326 |
| 6,198,410 B1 | * | 3/2001 | White et al. | 340/907 |
| 6,204,777 B1 | * | 3/2001 | Lyons | 340/908 |

* cited by examiner

*Primary Examiner*—Daniel J. Wu
*Assistant Examiner*—Davetta W. Goins

(57) ABSTRACT

A robotic traffic signalling device for reducing the need for deploying workers at various construction sites. The robotic traffic signalling device includes a weighted base member for resting upon a ground surface; and also includes a statute-like member being shaped like that of human being and being generally hollow and being securely mounted upon the weighted base member and having a body member, a head-like member with a hat-like member being securely attached upon the head-like member and also having at least one arm-like member having a hand-like member attached thereto; and further includes an elongate support member having an open top end and having bore extending there-through and being attached to the hand-like member and extending upwardly therefrom; and also includes a traffic sign member including a wall having a first side and a second side and being rotatably mounted upon the elongate support member and also displaying a message thereupon; and further includes light-emitting members being disposed upon and about the wall of the traffic sign member and being disposed within the hat-like member and also being disposed upon and in the body member; and also includes a rotating assembly for rotating the traffic sign member.

1 Claim, 3 Drawing Sheets

ROBOTIC TRAFFIC SIGNALLING DEVICE

BACKGROUND OF THE INVENTION

1. Field of the Invention

The present invention relates to a safe traffic control apparatus and more particularly pertains to a new robotic traffic signalling device for reducing the need of deploying workers at various construction sites.

2. Description of the Prior Art

The use of a safe traffic control apparatus is known in the prior art. More specifically, a safe traffic control apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,199,756; 3,886,519; U.S. Pat. No. Des. 190,283; U.S. Pat. No. 4,641,251; U.S. Pat. No. 5,450,811; and U.S. Pat. No. 5,117,765.

While these devices fulfill their respective, particular objectives and requirements, the aforementioned patents do not disclose a new robotic traffic signalling device. The inventive device includes a weighted base member for resting upon a ground surface; and also includes a statute-like member being shaped like that of human being and being generally hollow and being securely mounted upon the weighted base member and having a body member, a head-like member with a hat-like member being securely attached upon the head-like member and also having at least one arm-like member having a hand-like member attached thereto; and further includes an elongate support member having an open top end and having bore extending therethrough and being attached to the hand-like member and extending upwardly therefrom; and also includes a traffic sign member including a wall having a first side and a second side and being rotatably mounted upon the elongate support member and also displaying a message thereupon; and further includes light-emitting members being disposed upon and about the wall of the traffic sign member and being disposed within the hat-like member and also being disposed upon and in the body member; and also includes a rotating assembly for rotating the traffic sign member.

In these respects, the robotic traffic signalling device according to the present invention substantially departs from the conventional concepts and designs of the prior art, and in so doing provides an apparatus primarily developed for the purpose of reducing the need for deploying workers at various construction sites.

SUMMARY OF THE INVENTION

In view of the foregoing disadvantages inherent in the known types of safe traffic control apparatus now present in the prior art, the present invention provides a new robotic traffic signalling device construction wherein the same can be utilized for reducing the need for deploying workers at various construction sites.

The general purpose of the present invention, which will be described subsequently in greater detail, is to provide a new robotic traffic signalling device which has many of the advantages of the safe traffic control apparatus mentioned heretofore and many novel features that result in a new robotic traffic signalling device which is not anticipated, rendered obvious, suggested, or even implied by any of the prior art safe traffic control apparatus, either alone or in any combination thereof.

To attain this, the present invention generally comprises a weighted base member for resting upon a ground surface; and also includes a statute-like member being shaped like that of human being and being generally hollow and being securely mounted upon the weighted base member and having a body member, a head-like member with a hat-like member being securely attached upon the head-like member and also having at least one arm-like member having a hand-like member attached thereto; and further includes an elongate support member having an open top end and having bore extending therethrough and being attached to the hand-like member and extending upwardly therefrom; and also includes a traffic sign member including a wall having a first side and a second side and being rotatably mounted upon the elongate support member and also displaying a message thereupon; and further includes light-emitting members being disposed upon and about the wall of the traffic sign member and being disposed within the hat-like member and also being disposed upon and in the body member; and also includes a rotating assembly for rotating the traffic sign member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new robotic traffic signalling device which has many of the advantages of the safe traffic control apparatus mentioned heretofore and many novel features that result in a new robotic traffic signalling device which is not anticipated, rendered obvious, suggested, or even implied by any of the prior art safe traffic control apparatus, either alone or in any combination thereof.

It is another object of the present invention to provide a new robotic traffic signalling device which may be easily and efficiently manufactured and marketed.

It is a further object of the present invention to provide a new robotic traffic signalling device which is of a durable and reliable construction.

An even further object of the present invention is to provide a new robotic traffic signalling device which is susceptible of a low cost of manufacture with regard to both materials and labor, and which accordingly is then susceptible of low prices of sale to the consuming public, thereby making such robotic traffic signalling device economically available to the buying public.

Still yet another object of the present invention is to provide a new robotic traffic signalling device which provides in the apparatuses and methods of the prior art some of the advantages thereof, while simultaneously overcoming some of the disadvantages normally associated therewith.

Still another object of the present invention is to provide a new robotic traffic signalling device for reducing the need for deploying workers at various construction sites.

Yet another object of the present invention is to provide a new robotic traffic signalling device which includes a weighted base member for resting upon a ground surface; and also includes a statute-like member being shaped like that of human being and being generally hollow and being securely mounted upon the weighted base member and having a body member, a head-like member having a hat-like member and being securely attached upon the body member and also having at least one arm-like member having a hand-like member attached thereto; and further includes an elongate support member having an open top end and having bore extending therethrough and being attached to the hand-like member and extending upwardly therefrom; and also includes a traffic sign member including a wall having a first side and a second side and being rotatably mounted upon the elongate support member and also displaying a message thereupon; and further includes light-emitting members being disposed upon and about the wall of the traffic sign member and being disposed within the hat-like member and also being disposed upon and in the body member; and also includes a rotating assembly for rotating the traffic sign member.

Still yet another object of the present invention is to provide a new robotic traffic signalling device that is easy and convenient to set up along a construction site.

Even still another object of the present invention is to provide a new robotic traffic signalling device that safeguards the construction workers without needing additional manpower for that purpose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
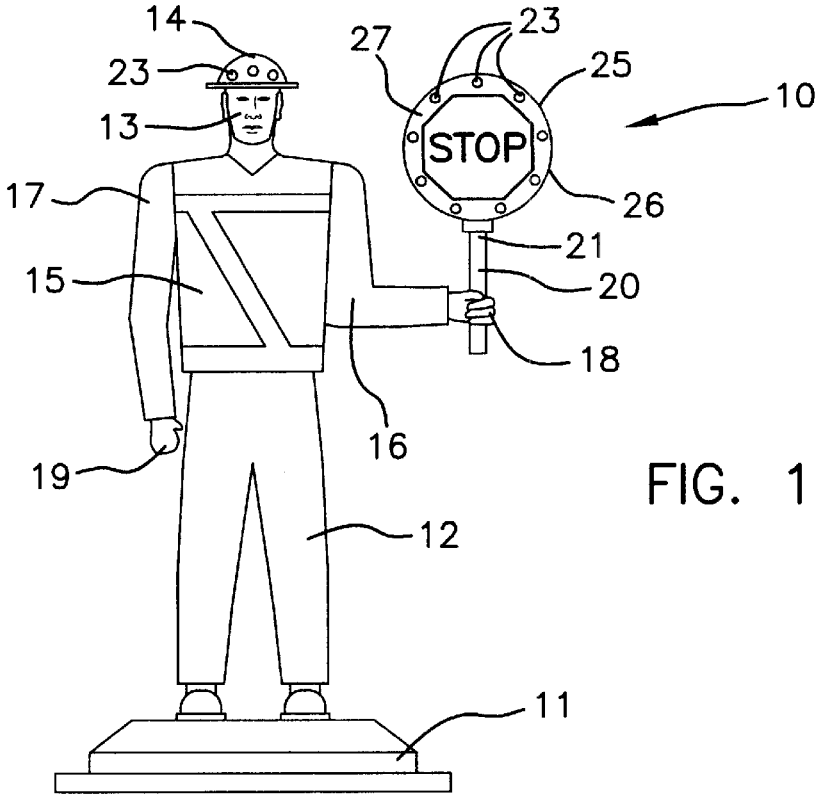
FIG. 1 is a front elevational view of a new robotic traffic signalling device according to the present invention.
Figure 2:
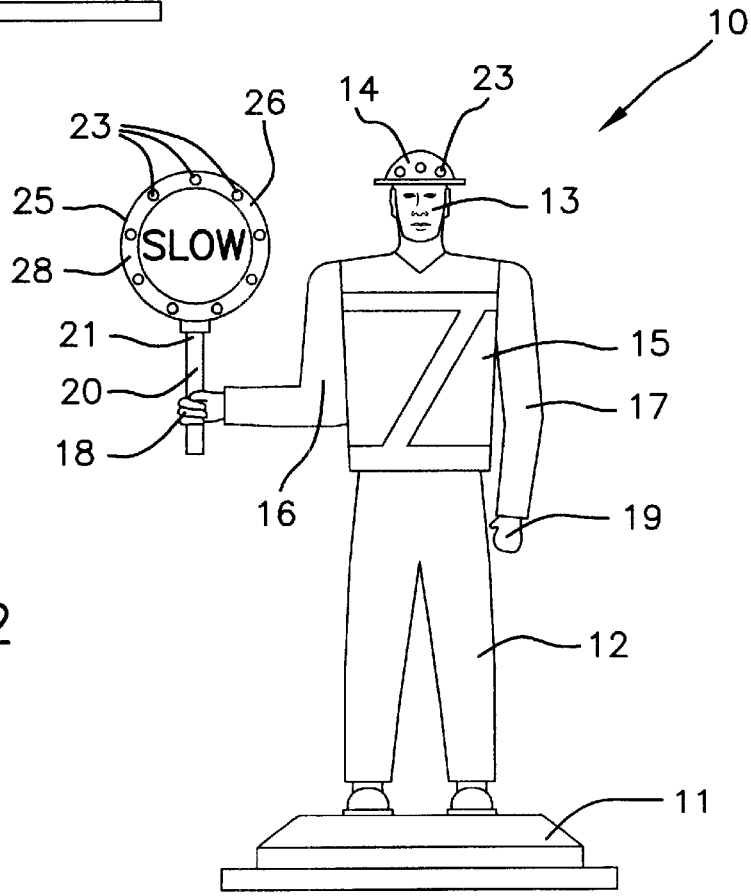
FIG. 2 is another front elevational view of the present invention.
Figure 3:
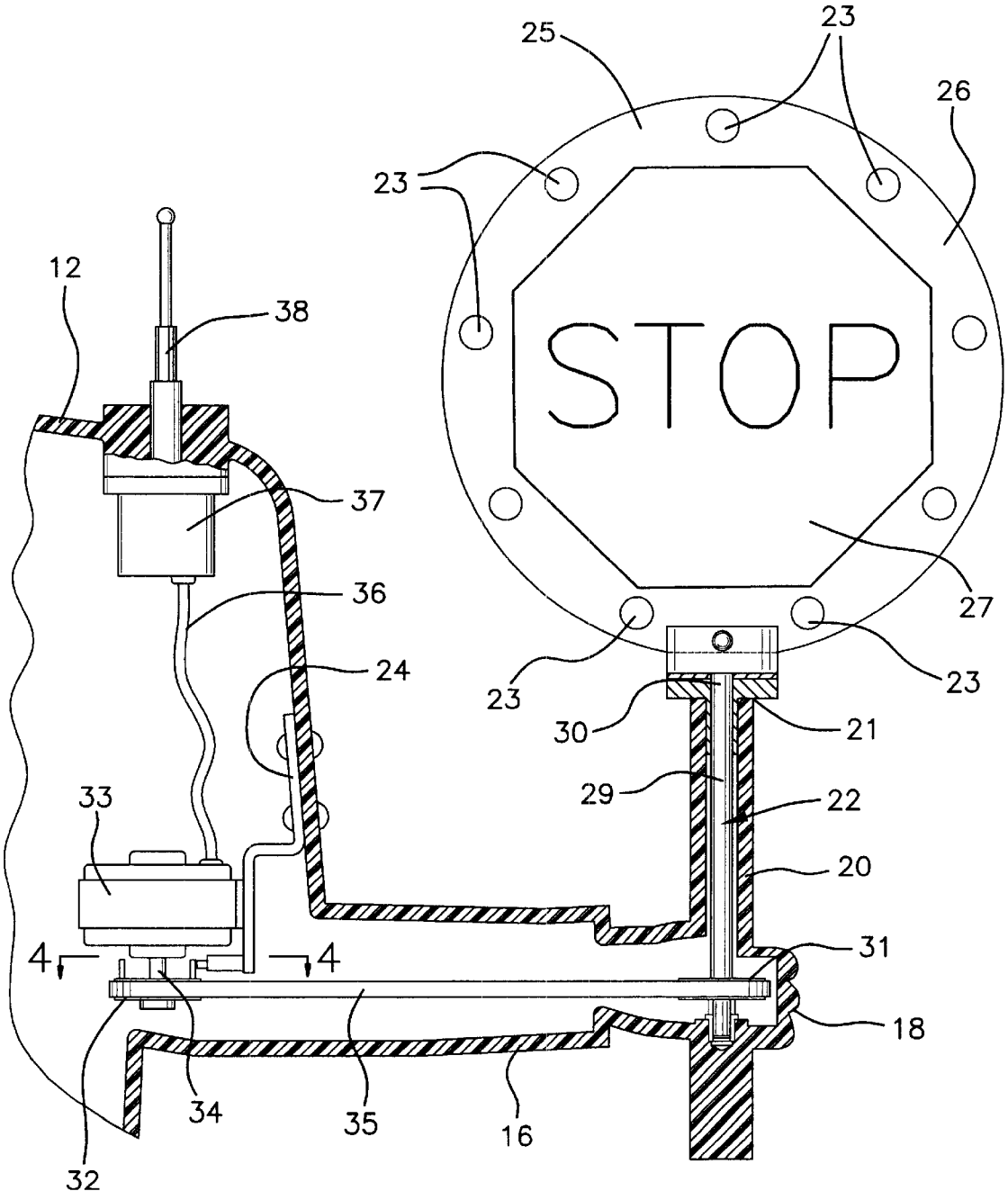
FIG. 3 is a partial cross-sectional view of the statute-like member of the present invention showing the means for rotating the traffic sign member.
Figure 4:
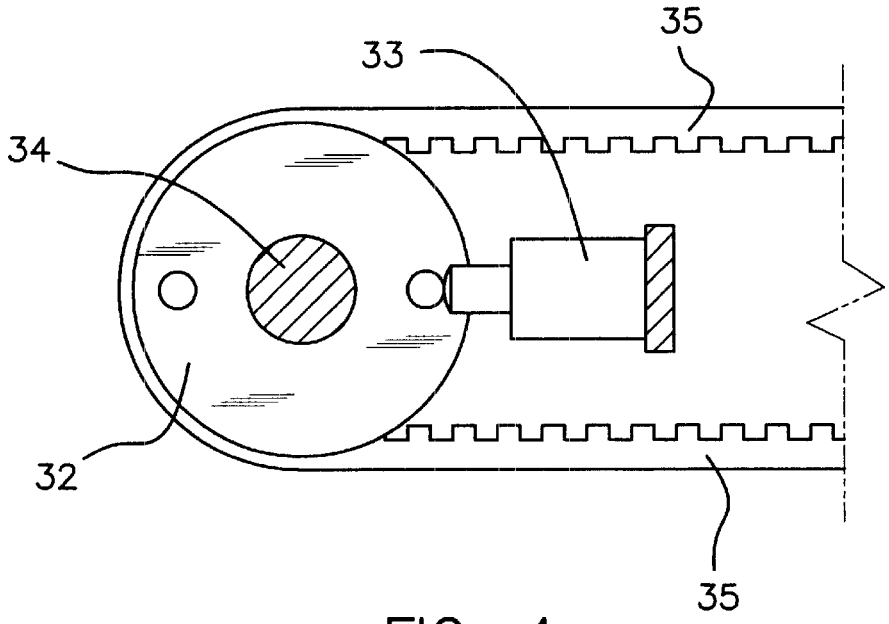
FIG. 4 is a top plan view of the second pulley member of the present invention.
Figure 5:
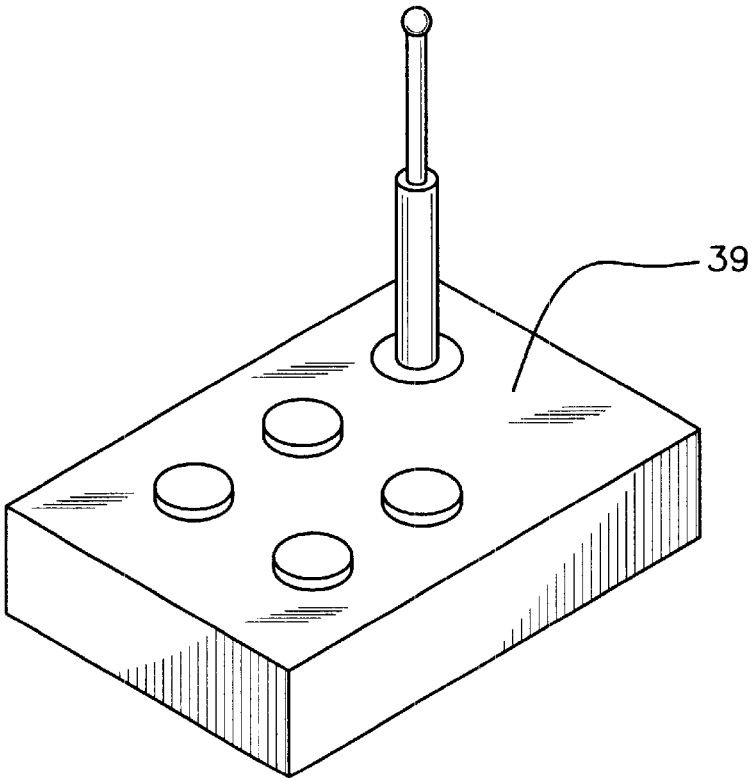
FIG. 5 is a perspective view of the radio transmitter of the present invention.

With reference now to the drawings, and in particular to FIGS. 1 through 5 thereof, a new robotic traffic signalling device embodying the principles and concepts of the present invention and generally designated by the reference numeral 10 will be described.

As best illustrated in FIGS. 1 through 5, the robotic traffic signalling device 10 generally comprises a weighted base member 11 for resting upon a ground surface; and also comprises a statute-like member 12 being shaped like that of human being and being generally hollow and being securely and conventionally mounted upon the weighted base member 11 and having a body member 15, a head-like member 13 having a hat-like member 14 and being securely and conventionally attached upon the body member 15 and also having two arm-like members 16,17 being securely and conventionally attached the body member 15 with each arm-like member 16,17 having a hand-like member 18,19 conventionally attached thereto. One of the arm-like members 16 includes an upper portion and a lower portion which is angled relative to the upper portion and which extends outwardly from the body member 15. The robotic traffic signaling device 10 also includes an elongate support member 20 having an open top end 21 and having bore 22 extending therethrough and being securely and conventionally attached to the hand-like member 18 of one of the arm-like members 16 and extending upwardly therefrom. A traffic sign member 25 includes a wall 26 having a first side 27 and a second side 28 and being rotatably and conventionally mounted upon the elongate support member 20 and also displaying a message thereupon with the traffic sign member 25 including a word "STOP" being displayed upon the first side 27 of the wall 26 thereof and also including a word "SLOW" being displayed upon the second side 28 of the wall 26 thereof. Light-emitting members 23 are conventionally disposed upon and about the wall 26 of the traffic sign member 25 and are conventionally disposed within the hat-like member 14 and also are conventionally disposed upon and in the body member 15.

A means for rotating the traffic sign member 25 includes an elongate sign support member 29 being rotatably disposed within the bore 22 of the elongate support member 20 and having a top end 30 which is securely and conventionally attached to the traffic sign member 25, and also includes a first pulley member 31 being conventionally mounted about the elongate sign support member 29, and further includes a motor 33 being securely and conventionally disposed within the body member 15 and having a motor shaft 34 rotatably attached thereto, and also includes a second pulley member 32 being conventionally mounted about the motor shaft 34, and further includes a radio receiver 37 being securely and conventionally disposed within the body member 15 and being connected to the motor 33 with wires 36 and being adapted to connect to a power source and having an antenna 38 extending outwardly from the body member 15, and also includes a radio transmitter 39 for energizing the motor 33 by sending a signal to the radio receiver 37, and further includes an endless belt 35 being carried about the pulley members 31,32. The elongate sign support member 29 has a bottom end which is journaled in a bottom portion of the elongate support member 20. The light-emitting members 23 are connected with wires 24 to the radio receiver 37.

In use, the robotic traffic signaling device 10 would be positioned along a road with the user energizing the light-emitting members 23 and rotating the traffic sign member 25 so that the appropriate side and message is facing the on-coming traffic. The traffic sign member 25 can be easily rotated by the user transmitting an appropriate signal from the radio transmitter 39 to the radio receiver 37.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A robotic traffic signaling device comprising:

a weighted base member for resting upon a ground surface;

a statute-like member having a physique resembling that of a human being and being generally hollow and being securely mounted upon said weighted base member and having an upper body member resembling that of a clothed human torso and a lower body member resembling that of clothed hips and legs and shod feet of a human, a head-like member having a hat-like member and being securely attached upon said upper body member, a pair of arm-like members, at least one of said arm-like members having a hand-like member attached thereto, and at least one of said arm-like members includes an upper portion and a lower portion which is angled relative to said upper portion and which extends outwardly from said body members such that said arm-like member resembles that of a human arm bending outwardly at an elbow;

an elongate support member having an open top end and having bore extending therethrough and being attached to said hand-like member and extending upwardly therefrom;

a traffic sign member including a wall having a first side and a second side and being rotatably mounted upon said elongate support member and also displaying a message thereupon, said traffic sign member including a word "STOP" being displayed upon said first side of said wall thereof, and also including a word "SLOW" being displayed upon said second side of said wall thereof;

light-emitting members being disposed upon and about said wall of said traffic sign member and being disposed within said hat-like member and also being disposed upon and in said body member;

means for rotating said traffic sign member including an elongate sign support member being rotatably disposed within said bore of said elongate support member and having a top end which is securely attached to said traffic sign member, and also including a first pulley member mounted about said elongate sign support member, and further including a motor being securely disposed within said body member and having a motor shaft rotatably attached thereto, and also including a second pulley member being mounted about said motor shaft, and further including a radio receiver being securely disposed within said body member and being connected to said motor with wires and being adapted to connect to a power source and having an antenna extending outwardly from said body member, and also including a radio transmitter for energizing said motor by sending a signal to said radio receiver, and further including an endless belt being carried about said pulley members, said elongate sign support member having a bottom end which is journaled in a bottom portion of said elongate support member, said light-emitting members being connected with wires to said radio receiver; and wherein said statue-like member has a height measuring between approximately five and a half feet and seven and a half feet.

* * * * *